US005967617A

United States Patent [19]

Zapanta

[11] Patent Number: 5,967,617

[45] Date of Patent: Oct. 19, 1999

[54] FILAMENT TAPE FOR CLEANING AND DENTAL APPLICATION

[76] Inventor: Gary Zapanta, 3203 Shelter Creek La., San Bruno, Calif. 94066

[21] Appl. No.: 09/033,470

[22] Filed: Mar. 2, 1998

[51] Int. Cl.[6] ..... A46D 1/00

[52] U.S. Cl. ..... 300/21; 15/167.1; 15/207.2

[58] Field of Search ..... 15/179, 167.1, 15/187, 188, 207.2; 300/21

[56] References Cited

U.S. PATENT DOCUMENTS

| | | | |
|---|---|---|---|
| Re. 26,403 | 6/1968 | Kutik | 15/187 |
| 834,853 | 10/1906 | Warren | 15/187 |
| 1,475,102 | 11/1923 | Withycombe | 15/188 |
| 1,767,313 | 6/1930 | Salvucci | 15/187 |
| 2,418,344 | 4/1947 | Goldberg | 15/187 |
| 2,796,047 | 6/1957 | Lehr | 15/187 |
| 3,604,043 | 9/1971 | Lewis, Jr. | 15/183 |
| 4,366,592 | 1/1983 | Bromboz | 300/21 |
| 5,588,172 | 12/1996 | Biocca | 15/179 |

FOREIGN PATENT DOCUMENTS

| | | | |
|---|---|---|---|
| 1095781 | 12/1960 | Germany | 15/207.2 |
| 301563 | 10/1965 | Netherlands | 15/187 |
| 185347 | 9/1922 | United Kingdom | 15/188 |

*Primary Examiner*—Randall E. Chin
*Attorney, Agent, or Firm*—Ray K. Shahani, Esq.

[57] ABSTRACT

A cleaning device and method of manufacture comprising (1) a cleaning tape element comprising a plurality of individual filaments such as bristles or fibers, the plurality of individual filaments each having (i) a cleaning tip disposed at a first end of the filament, and (ii) a second end, and (iii) means for maintaining the plurality of individual filaments in at least one, single filament-wide row, thereby forming a tape and (2) a base portion, the plurality of individual filaments coupled to the base portion adjacent their respective base ends.

6 Claims, 9 Drawing Sheets

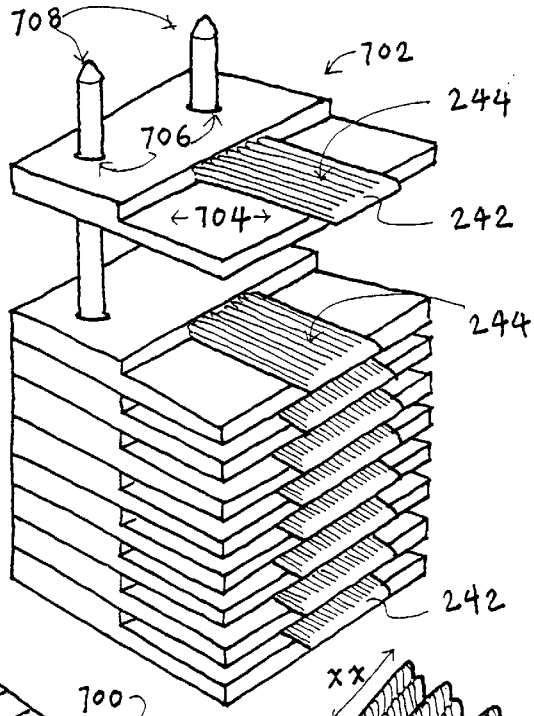
FIG. 9A
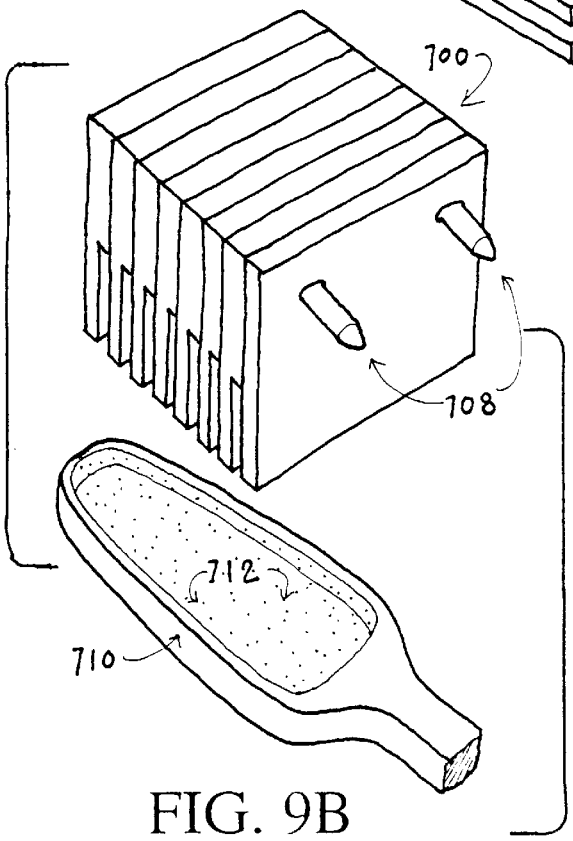
FIG. 9B
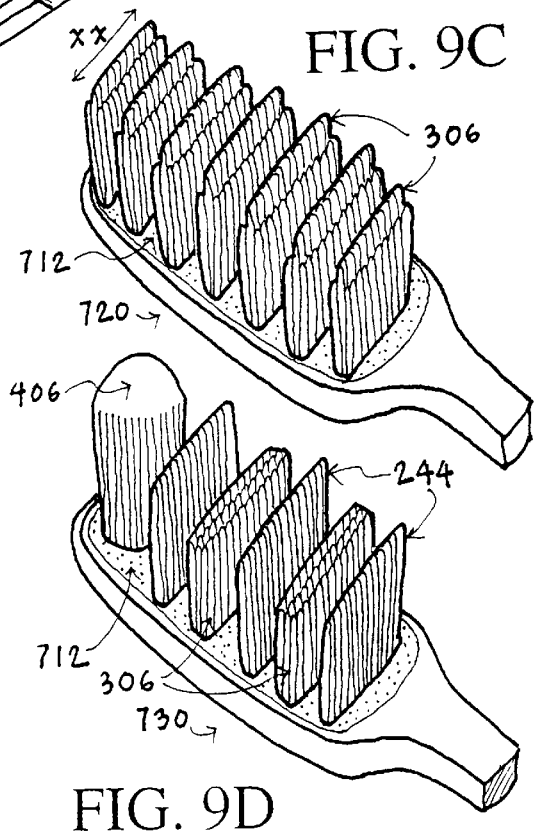
FIG. 9C
FIG. 9D

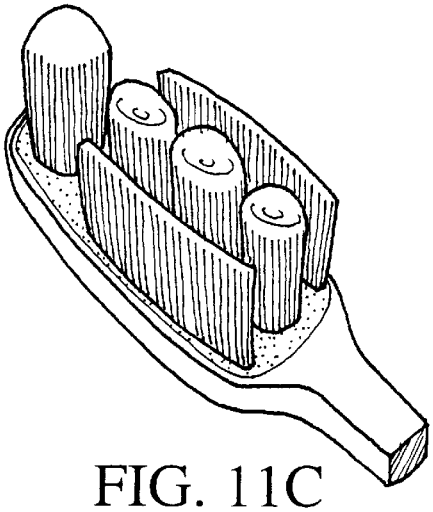
FIG. 11C
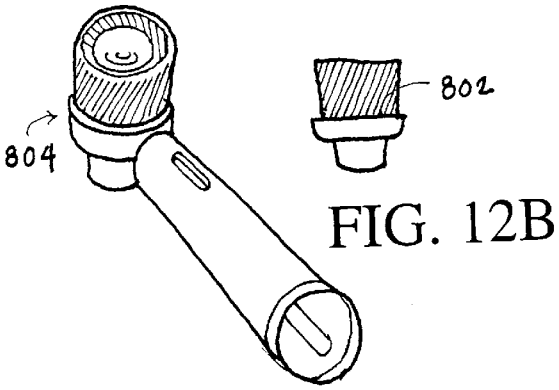
FIG. 12B
FIG. 12A
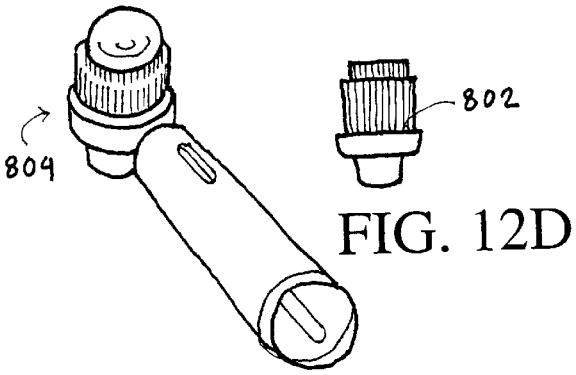
FIG. 12D
FIG. 12C

FILAMENT TAPE FOR CLEANING AND DENTAL APPLICATION

FIELD OF THE INVENTION

The present invention relates to devices for cleaning teeth and gums, and more particularly, the invention relates to a filament tape or ribbon consisting of a single layer, strip or row of individual tooth and mouth cleaning bristles, fibers or filaments coupled together along a unitary base portion for use in toothbrushes and other dental devices.

BACKGROUND OF THE INVENTION

The toothbrush is one of the most common devices known to man. Modern twentieth-century oral hygiene for people in all parts of the world includes the daily use of a tooth brush of some sort, often used more than once per day and often used in conjunction and/or association with other devices, including dental floss, dental tapes, regular wooden or plastic toothpicks, water picks, gum stimulators and the like.

The typical pharmacy carries numerous types of toothbrushes, including different sizes, such as for children or for adults, different stiffness bristles, such as "soft", "medium" and "hard", as well as numerous different manufacturers which each typically have their own unique features, including various colors or patterns, various sized or shaped handles, etc.

Polyester or other polymeric fibers such as are typically used in modern toothbrushes have long been available. They can be found in various lengths, i.e. wound on spools or precut, of various thicknesses and materials, and having other varying characteristics, including stiffness, roughness, durability, etc. The tips of the bristles can be treated in a variety of different ways. They can all be cut to an identical height, they can be given varying heights, such as is well known, to provide a contoured or more efficient toothbrush, and they can be set into the head of the toothbrush at any of a variety of different angles or combinations of angles.

Typically, bristles on a toothbrush are bundled together, and individual bundles or clusters of bristles are then set into the head of the toothbrush handle. This procedure is well known and universally practiced, essentially to the exclusion of all others. Bundles of fibers are either stapled into the head, typically using a small metal or plastic section, or they are fused together, such as by heat, and then the bundles placed into holes on the head of a toothbrush, or the bundles are set into a mold for further processing.

Numerous designs for bristles are known to those skilled in the art. Bristles are often given a roughened surface at the tip or at other portions. A given bundle of bristles may have a rounded tip profile, or they may be cut to form an opening or cup like structure, known as a "prophy cup". The bundles of bristles may also be set into the head of the toothbrush in a certain, predetermined pattern, such as a diamond shape, rows or columns, etc. The height of the bundles of bristles can taper, be wavy, or have any other tip profile. These designs are typically constructed with the objective of improving cleaning efficiency of the brushes.

Dentists, periodontists, oral hygienists and others in the health and personal hygiene industries have long been aware of the need to provide a convenient device, such as a toothbrush, etc., to clean the interstitial and interproximal areas of the teeth and gums. Numerous picks and brushes are designed to penetrate the spaces between the gum and the tooth, as far as in needed, to clean food particles, plaque, bacteria and other foreign material from those areas, thereby improving gingival and periodontal health.

The drawbacks of the prior art are numerous. A rounded or spiked bundle of bristles may not always provide the clearance for the longest bristles to penetrate the gum/tooth interproximal areas as deeply as possible. Furthermore, the longest bristles may become worn, frayed or otherwise less than the most efficient. The typical prophy cup design suffers for the same reason—the great number of bristles around the outside of the cup often don't allow a great number of individual fibers to achieve interproximal penetration.

ADVANTAGES AND SUMMARY OF THE INVENTION

Thus, it is an advantage of the present invention to provide a device for oral hygiene which is capable of achieving greater interproximal penetration than the devices of the prior art.

It is a further advantage of the present invention to provide a novel and unique single filament-wide or fiber-wide tape of filaments, the tape formed by the individual fibers or filaments bonded to a unitary base section.

It is a further advantage of the present invention to provide a novel and unique method of manufacturing a single filament-wide tape of filaments, the tape formed by the individual fibers or filaments bonded to a unitary base section.

It is a further advantage of the present invention to provide a cleaning device such as a toothbrush which is constructed using a single filament-wide tape of filaments, the tape formed by the individual fibers or filaments bonded to a unitary base section.

It is a further advantage of the present invention to provide a novel and unique multiple filament-wide tape of filaments, the tape formed by the individual fibers or filaments bonded to a unitary base section.

It is a further advantage of the present invention to provide a novel and unique method of manufacturing a multiple filament-wide tape of filaments, the tape formed by the individual fibers or filaments bonded to a unitary base section.

It is a further advantage of the present invention to provide a cleaning device such as a toothbrush which is constructed using a multiple filament-wide tape of filaments, the tape formed by the individual fibers or filaments bonded to a unitary base section.

It is a further advantage of the present invention to provide a method for manufacturing a cleaning device such as a toothbrush which is constructed using a single or multiple filament-wide tape of filaments, the tape formed by the individual fibers or filaments bonded to a unitary base section.

It is a further advantage of the present invention to provide a cleaning device such as a toothbrush which is constructed using a wound, single or multiple filament-wide tape of filaments, the tape formed by the individual fibers or filaments bonded to a unitary base section.

It is a further advantage of the present invention to provide a cleaning device such as a prophy cup which is constructed using a wound, single or multiple filament-wide tape of filaments, the tape formed by the individual fibers or filaments bonded to a unitary base section.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 9A is a preferred embodiment of a modular tang mandrel or mounting plate assembly for a tooth, teeth and mouth cleaning device having the single or multiple filament-wide tapes of filaments of the present invention.

FIG. 9B is a preferred embodiment of the method of use of the modular tang mandrel or mounting plate assembly of FIG. 9A.

FIG. 9C is a preferred embodiment of a tooth, teeth and mouth cleaning device 720 formed using the device and methods of FIGS. 9A and 9B.

FIG. 9D is another preferred embodiment of a tooth, teeth and mouth cleaning device 730 formed using the device and methods of FIGS. 9A and 9B.

FIGS. 11A–11C are preferred embodiments of the tooth, teeth and mouth cleaning devices of the present invention, such as formed using the devices of FIGS. 10A and 10B.

FIGS. 12A–12D are representative isometric and profile views of preferred embodiments of a rotary, mechanical tooth, teeth and mouth cleaning device having a circular, single or multiple fiber-wide tape of filaments of the present invention.

DETAILED DESCRIPTION OF THE PREFERRED EMBODIMENT

Figure 1C:
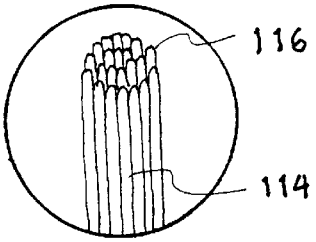
FIG. 1C (Prior Art)
FIG. 1C is a representative detail view of the distal tips of a bundle of bristles of a toothbrush of the prior art.

It will be understood that while numerous preferred embodiments of the present invention are presented herein, many of the individual elements and functional aspects of the embodiments are similar. Therefore, it will be understood that structural elements of the numerous apparatus disclosed herein having similar or identical function may have like reference numerals associated therewith.

Figure 1A:
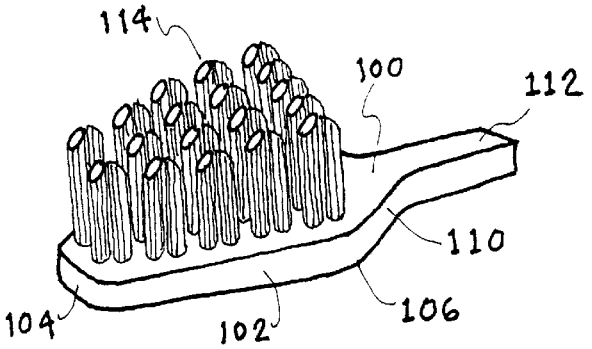
FIG. 1A (Prior Art)
FIGS. 1A and 1B are representative isometric views of various toothbrush heads of the prior art.
Figure 1B:
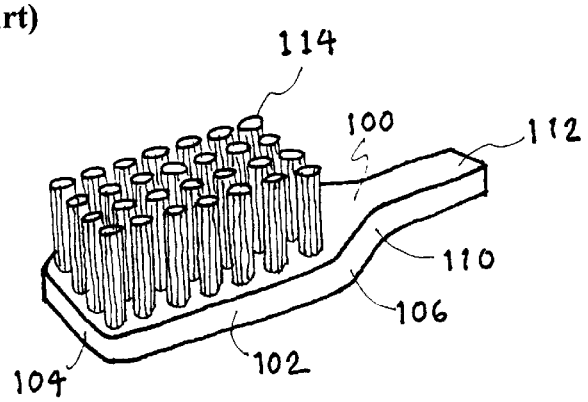
FIG. 1B (Prior Art)

FIGS. 1A and 1B are representative isometric views of various toothbrush heads of the prior art. FIG. 1C is a representative detail view of the distal tips of a bundle of bristles of a toothbrush of the prior art. As described with respect to the prior art, various shapes and bristle bundle configurations are known. In general, however, some of the relevant parts of a toothbrush head 100 for the present purposes consist of the base portion 102 having a distal end 104 and a proximal end 106, a shoulder 110 which usually consists of a tapering of the proximal end 106 of the base portion 102, the neck 112 which couples the head 100 to the handle portion (not shown) adjacent the shoulder 110, and the bundles 114 of bristles 116.

It will be understood that the shape of the base portion 102 can be varied, but in general is rather rectangular and/or otherwise slightly elongated. The bundles 114 of bristles 116 may take many different forms, including all flat on top and placed symmetrically as shown in FIG. 1B, or otherwise as shown in FIG. 1A. Such additional forms include the bundles 114 rounded on top, the heights of adjacent bundles 114 can be identical, varied slightly or comprise significant discontinuities with respect to heights of adjacent bristles 116 within a given bundle 114.

Figure 1D:
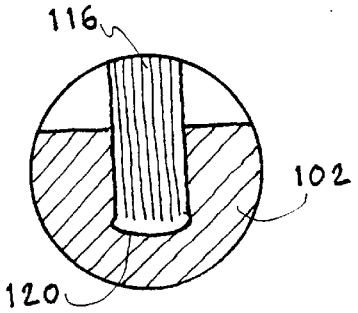
FIG.1D (Prior Art)
FIGS. 1D and 1E are representative detail views of a fused end and a stapled end, respectively, of a bundle of bristles of a toothbrush of the prior art.
Figure 1E:
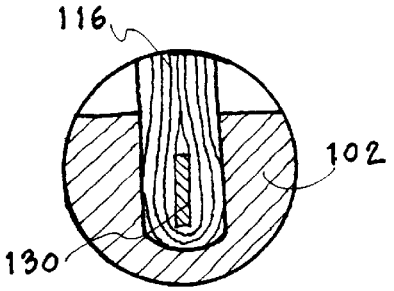
FIG. 1E (Prior Art)

FIGS. 1D and 1E are representative detail views of a fused end and a stapled end, respectively, of a bundle of bristles of a toothbrush of the prior art. Virtually the only known methods of coupling the individual bundles 114 of bristles 116 to the base portion 102 of the head 100 are adhesives, fusion or stapling. FIG. 1D shows a bundle 114 of bristles 116 set into the base 102 of a head 100 of a toothbrush. An intermediate layer 120 may consist of a layer of adhesive, such as glue or epoxy, or may consists of a unitary mass of melted ends of individual fibers or filaments which have been fused together at their lower portions. Similarly, FIG. 1E shows a bundle 114 of bristles 116 which have been stapled into the head portion 102. A staple 130, such as made of metal, is commonly found in the typical toothbrush of the prior art.

Figure 2A:
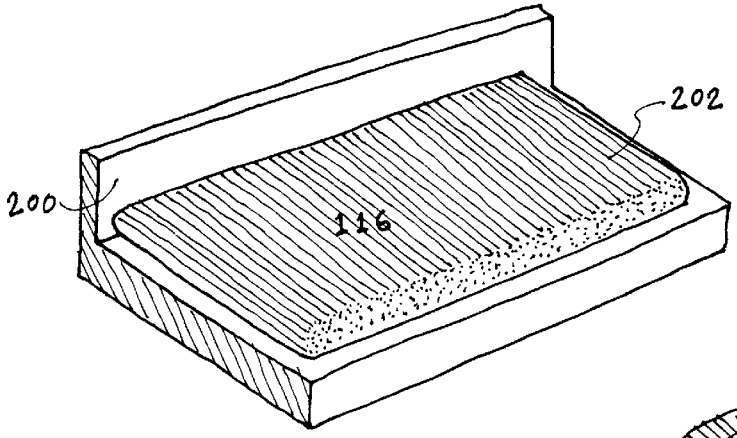
FIGS. 2A, 2B and 2C are representative schematic views of a method of manufacturing a single filament-wide tape of filaments of the present invention, the tape formed by the individual fibers or filaments bonded to a unitary base section.
Figure 2B:
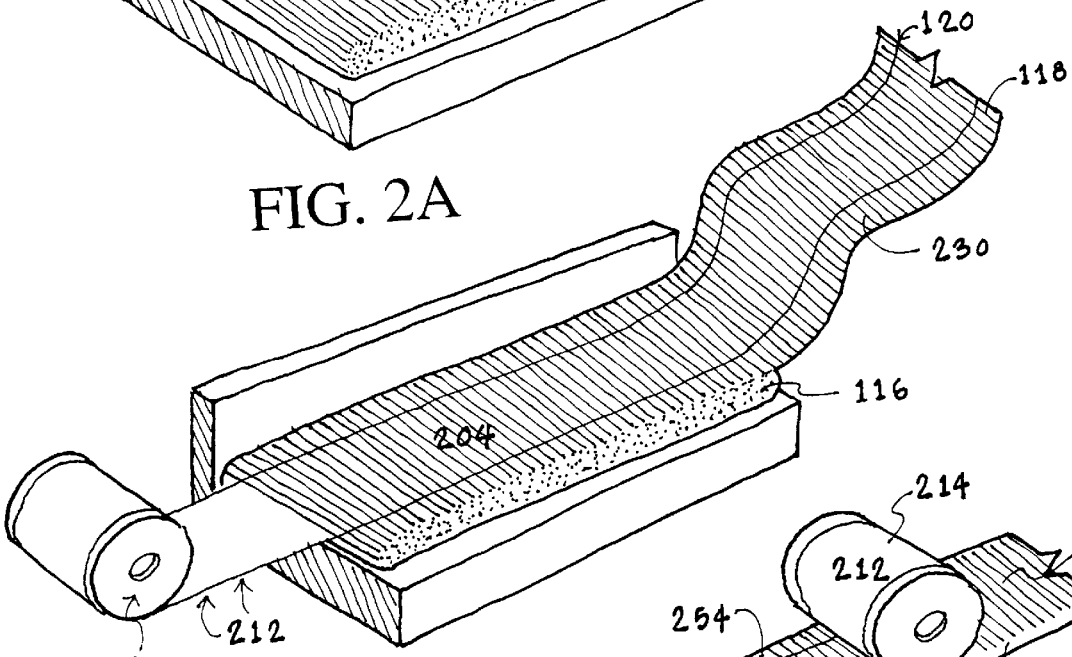
Figure 2C:
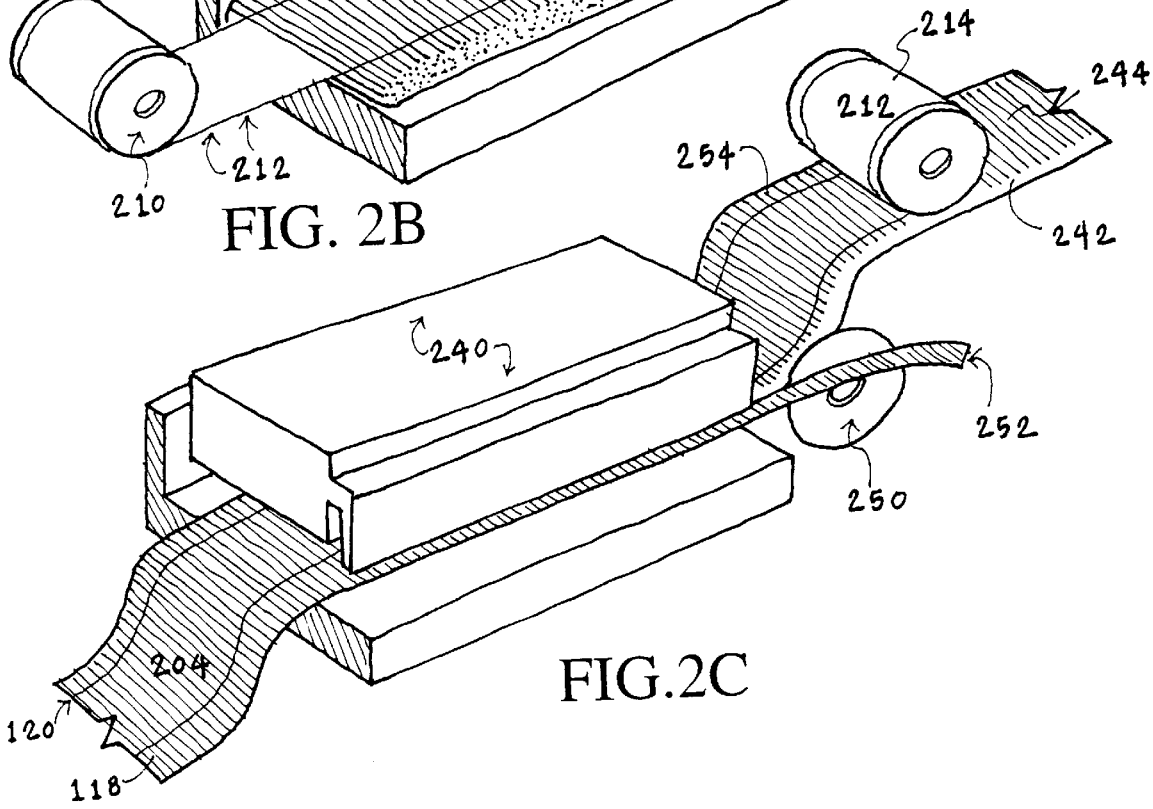

FIGS. 2A, 2B and 2C are representative schematic views of a preferred method of manufacturing a single filament-wide tape of filaments of the present invention, the tape formed by the individual fibers or filaments bonded to a unitary base section. In FIG. 2A, a tray 200 or other flat, planar, operative support means provides a thick layer 202 of fibers 116. The individual fibers 116 are arranged as shown, in a rather flat, planar manner as shown. FIG. 2B shows a source roll of adhesive material 210, such as a roll of adhesive tape, with an adhesive-coated or otherwise tacky, material attractive lower surface 212. It will be understood that only one side of the roll of adhesive material 210 need have the adhesive properties, and such properties may be formed by an adhesive layer, a magnetic or electric charge, by providing a fiber-clinging fabric or material or other contoured surface on the roll of adhesive 210.

Once the attractive lower surface 212 of the adhesive material 204 is placed in contact with the thick layer 202 of fibers 116, a single fiber-thick row or layer of fibers 230 is formed and is initially adhered to the attractive surface 212 of the adhesive material 204. It will be understood that the fibers are all axially aligned, essentially parallel to one another. Each fiber 116 has a base end 118 and a tip end 120 extending out from underneath the adhesive material 204.

In a third step, as shown in FIG. 2C, a heat seal or other sealing means device 240 forms a co-extensive fused portion 242 of the base end 118 of the individual fibers 116. In the case of polyester, plastic, other polymeric and synthetic, extruded or polymerized materials, heat sensitivity causes at least a portion of the base ends 118 of the bristles to become fused to the adjacent bristles, forming a single filament-wide tape of filaments 244. The adhesive material 204 can be rolled up in a take-up roll 214, thereby separating the individual fibers 116 of the single filament-wide tape of filaments 244 from the attractive side 212 of the adhesive material 204.

It will be understood that, inasmuch as not all bristles of a single filament-wide tape of filaments may be heat sensitive, such as would be the case with various natural fibers, etc., other methods of forming the single filament-wide tape of filaments of the present invention include application of adhesives, application of a portion of adhesive tape or other material on either side of the mono-layer of fibers to hold the individual fibers together in an essentially single file, single filament-wide tape of filaments. Additionally, means for fusing, holding or bonding certain portions of the base ends 118 of the individual fibers 116 include crimping, pressure bonding or fusing, higher or lower heat treatment, braiding, stitching, weaving, interconnection, etc. In any event, a cutting element 250 may sever a first section 252 or a second section 254 of the base ends 118 of the fibers 116. It will be understood, therefore, that a continuous strip of single filament-wide tape of filaments 244 may thus be formed.

Figure 3:
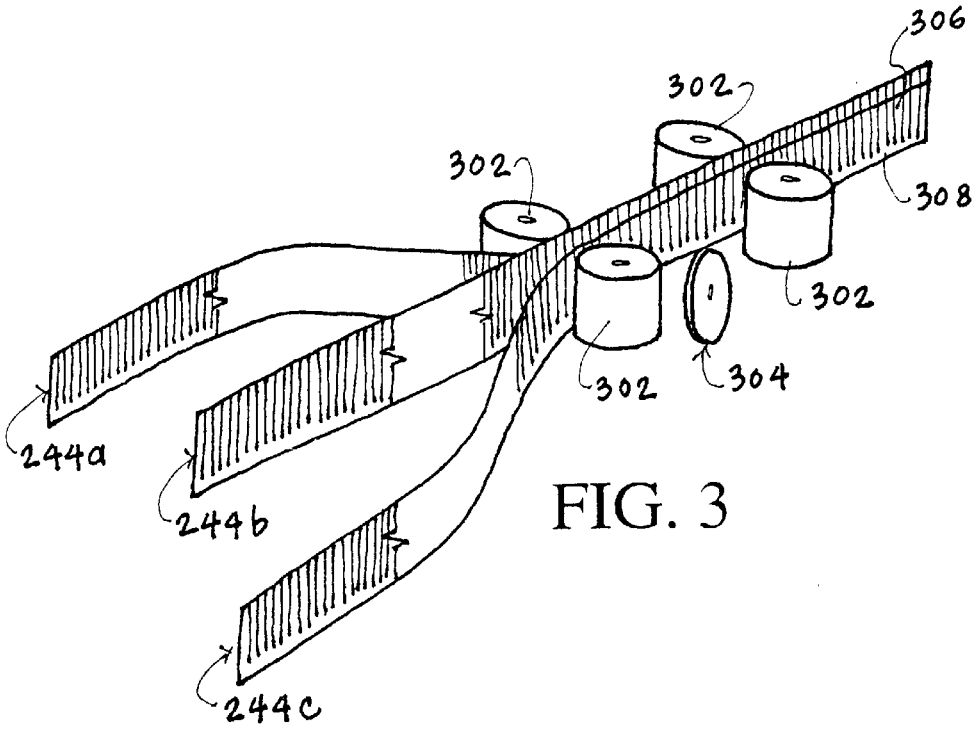
FIG. 3 is a representative schematic view of a method of manufacturing a multiple filament-wide tape of filaments of the present invention, the tape formed using one or more single filament-wide tapes of filaments, the tapes individually formed using filaments bonded to unitary base sections.

FIG. 3 is a representative schematic view of a method of manufacturing a multiple filament-wide tape of filaments of the present invention, the tape formed using one or more single filament-wide tapes of filaments. As shown in FIG. 2C, the height of individual fibers 116 forming the single filament-wide tape of filaments 244 of the present invention may be adjusted, and two or three or more different height, single filament-wide tape of filaments 244*a*, 244*b* and 244*c* of the present invention may be operatively aligned by aligning rollers 302. Heat seal or other sealing means device 304 forms an additional seal 308 at and between the co-extensive fused end portions 242 of the respective two or more single filament-wide tape of filaments 244*a*, 244*b* and 244*c*. The product of the method shown in FIG. 3 is a multiple filament-wide tape of filaments 306. As shown, a continuous strip of such multiple filament-wide tape of filaments 306 can thus be formed.

Figure 4A:
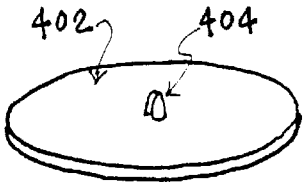
FIGS. 4A, 4B and 4C are representative schematic views of a method of manufacturing a wound, single filament-wide tape of filaments of the present invention, such as for forming a prophy tip.
Figure 4B:
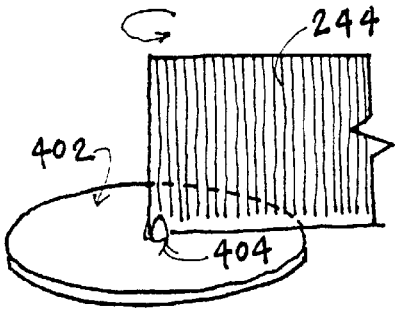
Figure 4C:
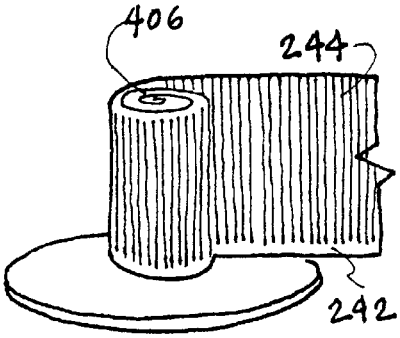

FIGS. 4A, 4B and 4C are representative schematic views of a method of manufacturing a wound, single filament-wide tape present invention, such as for forming a prophy tip. FIG. 4A shows a representative construction chuck 402 of the present invention. FIG. 4B shows an initial positioning of a section of single filament-wide tape of filaments 244 relative to the center point 404 of the chuck 402. Upon rotation of the chuck in the direction shown as X, the single filament-wide tape of filaments 244 winds about itself, maintaining parallelity between essentially all of the individual fibers 116 of the wound, single filament-wide tape of filaments 406. It will be understood that the method of producing the wound, single multiple filament-wide tape of filaments 406 of the present invention may be adapted, such as by use of the product of the method shown in FIG. 3, to form a wound, multiple filament-wide tape of filaments.

Figure 5A:
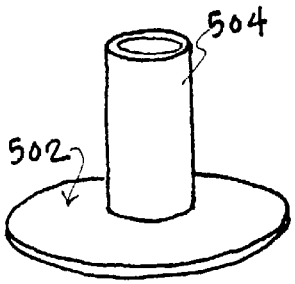
FIGS. 5A, 5B and 5C are representative schematic views of a method of manufacturing a circular, single filament-wide tape of filaments of the present invention, such as for forming a prophy cup.
Figure 5B:
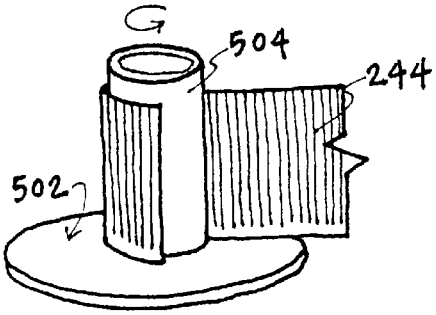
Figure 5C:
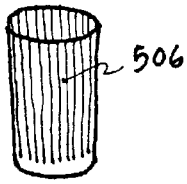

FIGS. 5A, 5B and 5C are representative schematic views of a method of manufacturing a circular, single filament-wide tape of filaments of the present invention, such as for forming a prophy cup. FIG. 5A shows a representative construction chuck 502 of the present invention. FIG. 5B shows an initial positioning of a section of single filament-wide tape of filaments 244 relative to the center hollow mandrel 504 of the chuck 502. Upon rotation of the chuck in the direction shown as X, the single filament-wide tape of filaments 244 winds about the central mandrel 504, maintaining parallelity between essentially all of the individual fibers 116 of the circular, single filament-wide tape of filaments 506. It will be understood that the method of producing the circular, single multiple filament-wide tape of filaments 506 of the present invention may be adapted, such as by use of the product of the method shown in FIG. 3, to form a circular, multiple filament-wide tape of filaments.

Figure 6C:
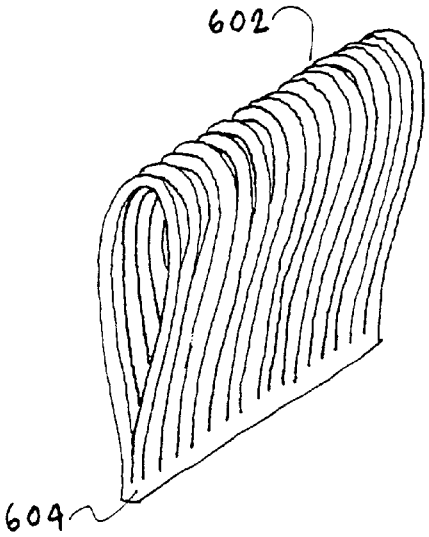
FIGS. 6A–6C are representative views of preferred embodiments of the single or multiple filament-wide tape of filaments of the present invention formed using filaments bonded to unitary base sections.
Figure 6A:
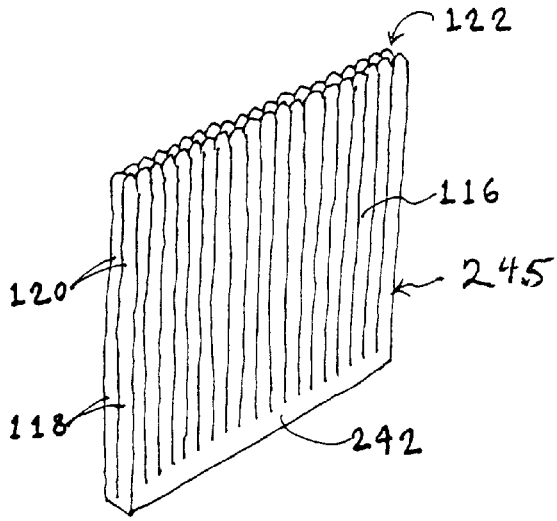
Figure 6B:
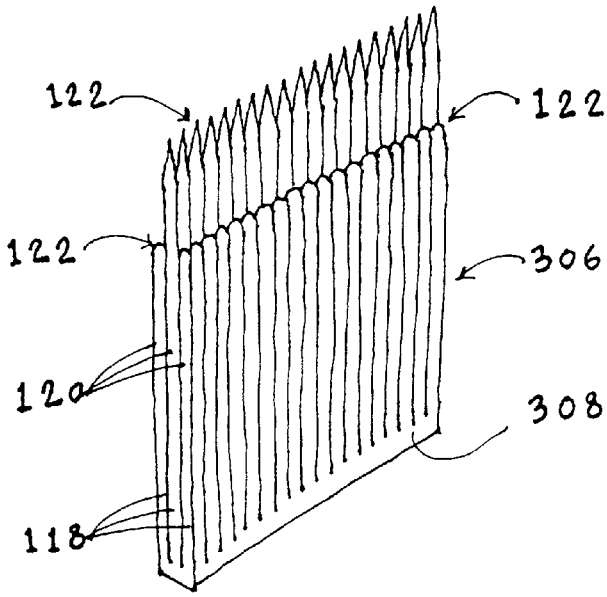

FIGS. 6A–6C are representative views of preferred embodiments of the single or multiple filament-wide tape of filaments of the present invention formed using filaments bonded to unitary base sections. FIG. 6A shows the double filament-wide tape of filaments 245 of the present invention. As shown in and described with respect to FIGS. 2A–2C, the continuous length of single filament-wide tape of filaments 244 can be cut into operatively sized pieces or sections, such as for placement on the head of a toothbrush. The single filament-wide tape of filaments 244 consists of individual bristles 116, each bristle 116 having a base end 118 and a tip 122 located at the tip end 120, and a lower, co-extensive fused portion 242 which holds each of the individual bristles 116 in a row and parallel to each other. This single filament-wide tape of filaments 244 forms an important element of the present invention.

FIGS. 6B and 6C show embodiments of the single filament-wide tape of filaments 244 of the present invention. FIG. 6B shows a looped, tape of filaments 602 formed of a plurality of individual bristles 116 looped and bonded to a unitary, co-extensive bonded portion 604. It will be understood that the embodiment shown in FIG. 6C can be formed using a method similar to that shown in and described with respect to FIGS. 2A–2C, e.g. starting with a single row or layer of individual fibers or bristles 116, forming a co-extensive bond or fusion or coupling portion 242 at two points across each bristle 116, and folding the double-bonded bristles 116 so as to be able to form the unitary, co-extensive bonded portion 604 between the two bonded portions 242.

FIG. 6C shows the multiple filament-wide tape of filaments 306 of the present invention. As shown in and described with respect to FIGS. 2A–2C and more particularly with respect to FIG. 3, the continuous length of multiple filament-wide tape of filaments 306 can be cut into operatively sized pieces or sections, such as for placement on the head of a toothbrush. The multiple filament-wide tape of filaments 306 consists of individual bristles 116, each bristle 116 having a base end 118 and a tip 122 located at the tip end 120, and a lower, co-extensive fused portion 308 which holds each of the individual bristles 116 in a row and parallel to each other. This multiple filament-wide tape of filaments 306 forms an important element of the present invention.

From the foregoing, it will be understood and known to those skilled in the art that, as shown in FIG. 6B, the tips 122 of one or more rows of the single or multiple filament-wide tape of filaments may be formed or otherwise provided with other, additional characteristics, including sharpened tips (as shown), rounded tips, roughened, flattened or angle cut, etc.

Figure 7A:
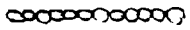
FIGS. 7A–7M are representative top, profile and isometric views of various embodiments of a single or multiple filament-wide tape of filaments of the present invention formed using filaments bonded to unitary base sections.

FIG. 7A shows a flat, single filament-wide tape of filaments 244 of the present invention in which the tips 122 of the bristles 116 may have identical heights or may have varying heights.

Figure 7B:
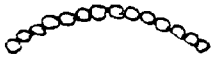

FIG. 7B shows a curved, single filament-wide tape of filaments 244 of the present invention in which the tips 122 of the bristles 116 may have identical heights or may have varying heights.

Figure 7F:
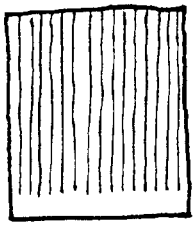
Figure 7G:
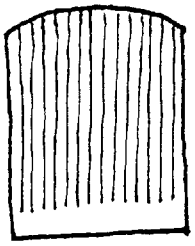
Figure 7H:
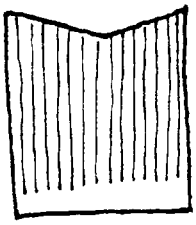
Figure 7C:
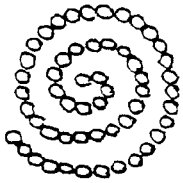

FIG. 7C shows a wound, single filament-wide tape of filaments 406 of the present invention in which the tips 122 of the bristles 116 may have identical heights or may have varying heights.

Figure 7D:
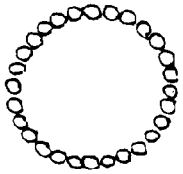

FIG. 7D shows a circular, single filament-wide tape of filaments 506 of the present invention in which the tips 122 of the bristles 116 may have identical heights or may have varying heights.

Figure 7E:
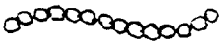

FIG. 7E shows a curved, single filament-wide tape of filaments 244 of the present invention in which the tips 122 of the bristles 116 may have identical heights or may have varying heights.

FIG. 7F shows a single or multiple, wound or circular, filament-wide tape of filaments of the present invention in which the tips 122 of the bristles 116 have identical heights.

FIG. 7G shows a single or multiple, wound or circular, filament-wide tape of filaments of the present invention in which the tips 122 of the bristles 116 have varying heights.

FIG. 7H shows a single or multiple, wound or circular, filament-wide tape of filaments of the present invention in which the tips 122 of the bristles 116 have varying heights.

Figure 7I:
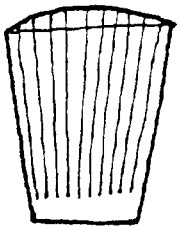

FIG. 7I shows an inverted, truncated and frustoconical shaped, single or multiple, wound or circular, filament-wide tape of filaments of the present invention in which the tips 122 of the bristles 116 have varying heights.

Figure 7J:
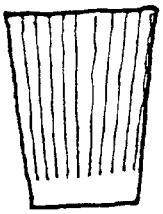

FIG. 7J shows an inverted, truncated and frustoconical shaped, single or multiple, wound or circular, filament-wide tape of filaments of the present invention in which the tips 122 of the bristles 116 have identical heights or have varying heights.

Figure 7K:
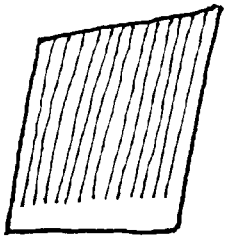

FIG. 7K shows a single or multiple, wound or circular, filament-wide tape of filaments of the present invention in which the tips 122 of the bristles 116 have varying heights, and in which the individual fibers 116 have a co-extensive, unitary bonded section 242 which lies in a plane not perpendicular to the paralellity which exists between the individual fibers 116. Thus, it will be apparent, that the individual fibers 116 need not stand perpendicular to the head 102 of a toothbrush, but may, rather, lay at some other operative, more interproximally penetrating position.

Figure 7L:
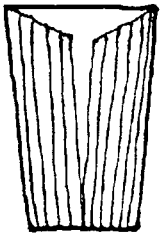

FIG. 7L shows an inverted, truncated and frustoconical shaped, single or multiple, circular, filament-wide tape of filaments 506 of the present invention in which the tips 122 of the bristles 116 have identical heights or have varying heights, in the shape of a prophy cup.

Figure 7M:
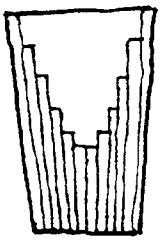

FIG. 7M shows an inverted, truncated and frustoconical shaped, single or multiple, wound, filament-wide tape of filaments 406 of the present invention in which the tips 122 of the bristles 116 have varying heights, in the shape of a prophy cup.

Figure 8A:
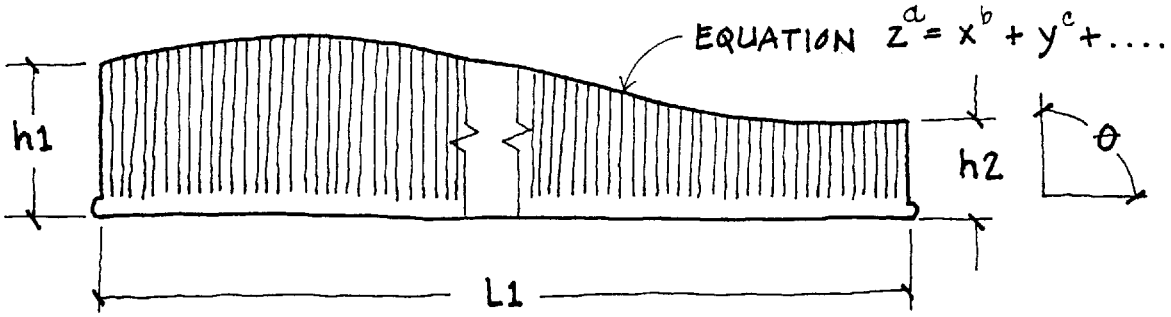
FIGS. 8A–8C are representative schematic illustrations of various design concepts embodied in various embodiments of the single and multiple filament-wide tape of filaments of the present invention.
Figure 8B:
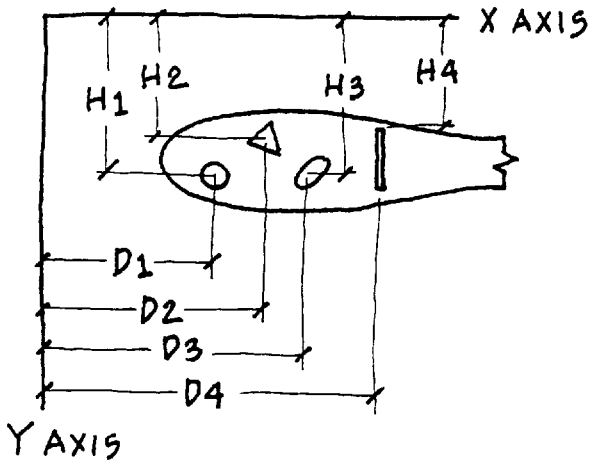
Figure 8C:
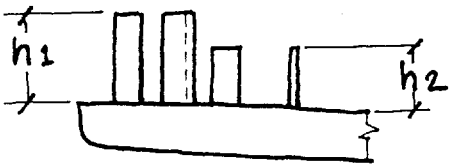

FIGS. 8A–8C are representative schematic illustrations of various design concepts embodied in various embodiments of the single and multiple filament-wide tape of filaments of the present invention.

In FIG. 8A, a representative schematic illustration of single and multiple filament-wide tape of filaments, especially as shown in and described with respect to FIG. 6A, is shown. It will be understood that in the mathematical or other physical description of the present invention, variables representing given physical characteristics are indicated, including L1 representing the overall length of the design, and h1 and h2 which represent different fiber or bristle tip heights. Additionally, an equation describing the variation in heights of individual fibers, as a function of axial position such as along L1, is shown in the standard multi-variant form:

$$z^a = x^b + y^c + \ldots \quad (1)$$

Furthermore, the angle of parallelity θ of the individual filaments, i.e. the angle at which the bristles stand relative to the plane of the unitary, bonded portion 242, is also shown.

FIG. 8B is a representative schematic illustration of the spatial orientation of tooth, teeth and mouth cleaning elements of the present invention to be mounted on the head of a toothbrush. It will be understood by the foregoing and following, to those skilled in the art, that for purposes of design, variables H1–H4 and D1–D4 describe, with precision, the spatial orientation of the individual tooth, teeth or mouth cleaning elements of the present invention to be mounted on the head of a toothbrush. As shown, therefore, each tooth or teeth or mouth cleaning element has associated variables descriptive of the elements' position on both the X-axis and the Y-axis.

FIG. 8C is another representative schematic illustration of the spatial orientation of tooth, teeth and mouth cleaning elements of the present invention to be mounted on the head of a toothbrush. It will be understood by the foregoing and following, to those skilled in the art, that for purposes of design, variables h1 and h2 describe, with precision, the spatial orientation of the individual tooth, teeth or mouth cleaning elements of the present invention to be mounted on the head of a toothbrush. As shown, therefore, each tooth or teeth or mouth cleaning element has associated variables descriptive of the elements' height relative to the head of the toothbrush.

FIG. 9A is a preferred embodiment of a modular tang mandrel or mounting plate assembly for a tooth, teeth and mouth cleaning device having the single or multiple filament-wide tapes of filaments of the present invention. It will be understood by the foregoing and following that the modular construction of the present invention is but one of many different possible embodiments of the present invention, and that based on the foregoing and following, further embodiments of such methods and devices for designing and manufacturing the tooth, teeth and mouth cleaning devices of the present invention would be obvious to those skilled in the art.

Therefore, and in no way limiting of the scope of the present invention, the embodiment shown in FIG. 9A shows the modular tang mandrel 700 consisting of numerous, individual tooth, teeth and/or mouth cleaning element supporting tangs 702. The individual tangs 702 each have a cleaning element support area 704 for supporting, mounting or otherwise holding the individual teeth cleaning elements in place. As shown, numerous single filament-wide tape of filaments 244 are mounted thereon with their respective lower, unitary, bonded portions 242 operatively aligned. Additionally, each individual tang 702 has a modular mounting means, such as a pair of holes 706, spaced according to the design of the toothbrush intended to be formed, such as with the tangs 702 each parallel to each other and spaced essentially equidistant from each other. As the orientation of the holes 706 has been predetermined, two coupling rods 708 pass through each of the mounting holes 706 on the individual tangs 702, thereby holding the numerous tangs 702 in place, as shown.

FIG. 9B is a preferred embodiment of the method of use of the modular tang mandrel or mounting plate assembly of FIG. 9A. As shown, once the tooth cleaning elements, such as the numerous single filament-wide tapes of filaments 244, have been placed on the individual tangs 702, and the tangs 702 have been stacked up and are held together, the mandrel 700 and the head base 710 of the toothbrush or other tooth, teeth or cleaning device, can be brought together as shown by directional arrow Z. It will be understood that the head base 710 may be a preformed individual piece, or one of a strip of base heads 710 on a continuous molding, extrusion, etc. Additionally, as will be recognized by those skilled in the art, either the mandrel assembly 700 or the toothbrush base head 710 can be held in place while the other is positioned relative to the fixed component.

As will be understood by the foregoing and following by those skilled in the art, base head 710 has a recessed area in which the unitary, bonded portions 242 of each tooth, teeth or mouth cleaning element 244, or other including the multiple layer-wide embodiment 306, the wound construction 406 or the circular construction 506, etc. is placed. Thereafter, liquid glue, heat-labile molding or forming powdered resin, clay or other polymeric or other flowable material can be placed into the recessed area 712 such that the individual cleaning elements of the toothbrush are held securely, immovably or as desired, in place. It will be understood that such flowable, liquid or other bonding material will be known to those skilled in the art and will be compatible with the materials of the present invention as well as for their intended, personal hygiene applications.

FIG. 9C is a preferred embodiment of a tooth, teeth and mouth cleaning device 720 formed using the device and methods of FIGS. 9A and 9B, and FIG. 9D is another preferred embodiment of a tooth, teeth and mouth cleaning device 730 formed using the device and methods of FIGS. 9A and 9B. With reference to both FIGS. 6A and 6B, the individual tooth, teeth or mouth cleaning elements comprise both single filament-wide tapes of filaments 244 and multiple filament-wide tape of filaments 306, mounted essentially parallel to each other. The device 730 shown in FIG. 9D also includes a wound filament-wide tape of filaments 406 in which the tips 122 of individual fibers 116 are all cut to a specific height so as to provide a prophy tip. Such tip could be replaced with the circular filament-wide tape of filaments 506, or a cup tip such as shown in FIG. 7M or other.

It will be clear, therefore, that proper use of such toothbrush includes rotation in a back and forth motion in the directions shown by double-headed arrow XX will permit interproximal penetration of individual fibers 116 and by portions of the individual filament tapes 244 formed of single filament-wide or fiber-wide rows of fibers or bristles 116. Such interproximal penetration will occur between and around adjacent teeth in the mouth, and between and around the teeth and the gums, other gingival structures, the root sections of the teeth, parts of the bone structures of the upper and the lower jaws of the user, as well as between and around any crevices, furcations, cavities or other potential characteristics of individual teeth, as well as between and around fillings, crown, caps, braces, retainers, other orthodontic or periodontic structures, etc.

Figure 10A:
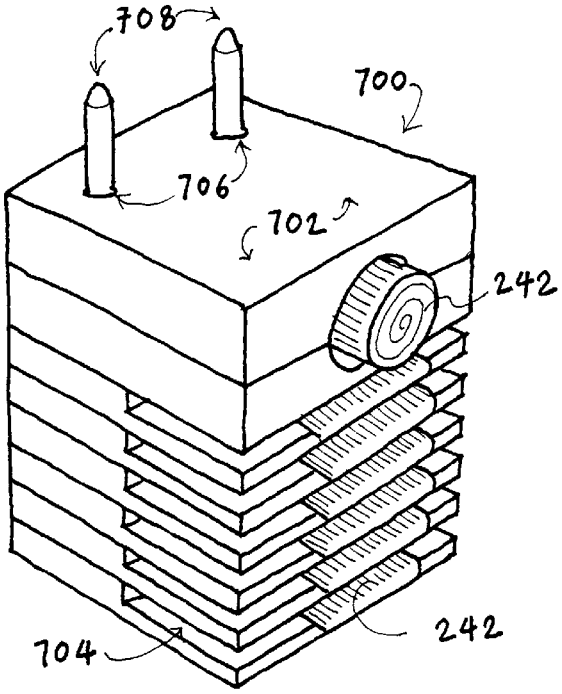
FIGS. 10A and 10B are preferred embodiments of modular tang and cavity mandrel assemblies for construction of tooth, teeth and mouth cleaning devices having the single or multiple filament-wide tapes of filaments of the present invention in conjunction with the wound and/or circular, single or multiple filament-wide tapes of filaments of the present invention.
Figure 10B:
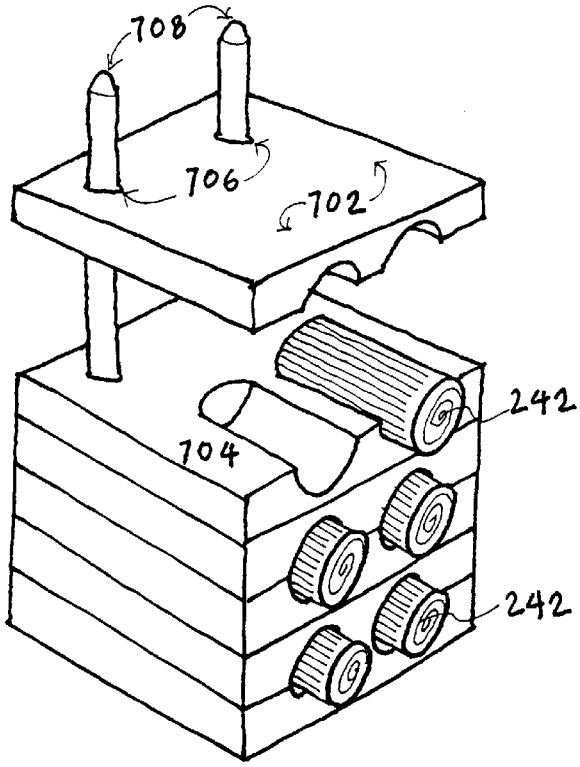

FIGS. 10A and 10B are preferred embodiments of modular tang and cavity mandrel assemblies for construction of tooth, teeth and mouth cleaning devices having the single or multiple filament-wide tapes of filaments of the present invention in conjunction with the wound and/or circular, single or multiple filament-wide tapes of filaments of the present invention. As shown, the mandrels 700 are formed of individual tang portions 702 which couple together and are held together by tie rods 708 through operatively spaced mounting holes 706, similar to that shown in FIG. 9A. Again, the unitary, bonded portions 242 of each tooth, teeth or mouth cleaning element 244, or other element including the multiple layer-wide embodiment 306, the wound construction 406 or the circular construction 506, etc. are placed onto and held in place by the supporting portions 704 of the tangs 702.

Figure 11A:
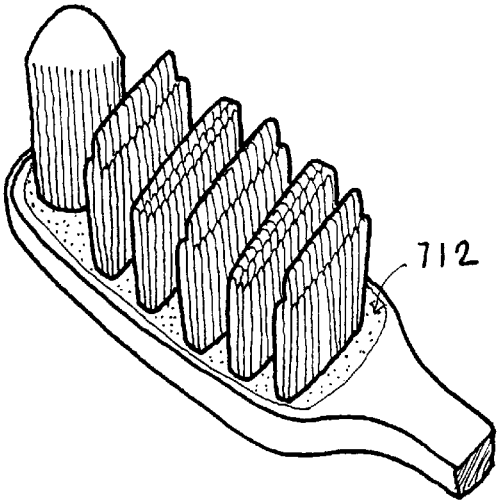
Figure 11B:
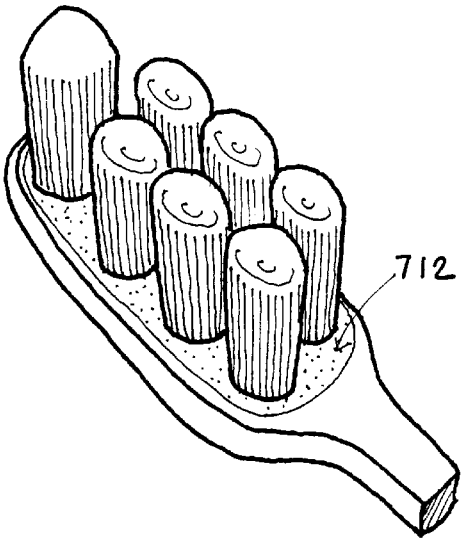

FIGS. 11A–11C are preferred embodiments of the tooth, teeth and mouth cleaning devices of the present invention, such as formed using the devices of FIGS. 10A and 10B. As shown, the different embodiments consist of combinations of the various tooth, teeth or mouth cleaning element 244, including the multiple layer-wide embodiment 306, the wound construction 406 or the circular construction 506, etc., of the present invention. As shown, the wound or circular elements may be in the form of prophy tips, prophy cups, flat platforms, etc. Furthermore, the orientation of the individual elements on the head base 710 of the toothbrush heads may be configured as desired, according to, aided by and in conjunction with the design considerations schematically represented in FIGS. 8A–8C.

As described with respect to the foregoing and in particular FIG. 9C, the mechanical action of the tooth cleaning elements of the present invention is directly related to the method of use by the consumer of the device. Using the devices of the present invention, interproximal penetration can be achieved between and around adjacent teeth in the mouth, and between and around the teeth and the gums, other gingival structures, the root sections of the teeth, parts of the bone structures of the upper and the lower jaws of the user, as well as between and around any crevices, furcations, cavities or other potential characteristics of individual teeth, as well as between and around fillings, crown, caps, braces, retainers, other orthodontic or periodontic structures, etc.

FIGS. 12A–12D are representative isometric and profile views of preferred embodiments of a rotary, mechanical tooth, teeth and mouth cleaning devices having circular or wound, single or multiple fiber-wide tapes of filaments of the present invention. As will be understood by those skilled in the art, electrically operated rotary toothbrushes are currently used throughout the world, having recently gained enormous popularity due, in part at least, to factors which include recent advances in construction of semiconductor control devices, enhanced mechanical materials and methods of construction including advances in the materials sciences, sealed, low-friction bearings, waterproof seals, housings and other materials, etc. Therefore, in the design of such devices in conjunction with the teachings of the present invention, the bristles 116 of the devices can be mounted perpendicularly to the plane of the toothbrush head 802, as shown in FIGS. 12C and 12D, or the bristles 116 of the devices can be mounted at an angle other than perpendicular to the head plane 802 as shown in FIGS. 12A and 12B. It will be understood that the head portions 804 of the devices shown in FIGS. 12A–12D can be rotary, oscillatory, etc.

Unless defined otherwise, all technical and scientific terms used herein have the same meaning as commonly understood by one of ordinary skill in the art to which this invention belongs. Although any methods and materials similar or equivalent to those described can be used in the practice or testing of the present invention, the preferred methods and materials are now described. All publications and patent documents referenced in this application are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A method for making a filament tape cleaning element toothbrush or other brush, the brush having one or more filament tape cleaning elements, the method including the following steps:

(A) Obtaining a plurality of individual filaments, bristles or fibers, the plurality of individual filaments each having (i) a cleaning tip disposed at a first end of the filament, and (ii) a second end;

(B) Maintaining the plurality of individual filaments in the same orientation relative to each other;

(C) Contacting the plurality of individual filaments with a continuous tape of adhesive material, the tape having a predetermined length, such that a single-wide row of individual filaments adheres to the adhesive material in an orientation essentially perpendicular to the lengthwise dimension of the tape, thereby forming a single-filament wide continuous tape of filaments adhered to adhesive material; and (D) Severing the continuous tape of filaments at a predetermined, operative position, thereby forming at least one single-filament wide filament tape cleaning element.

2. The method of claim 1 in which the plurality of individual filaments are made of a heat-fusible polymer, the method further comprising the following step:

(E) Forming a thermally fused, unitary portion of the tape of filaments co-extensive between the plurality of individual filaments after step (C) and before step (D).

3. The method of claim 2, further comprising the following step:

(F) Removing the adhesive material after step (E) and before step (D).

4. The method of claim 1, further comprising the following step:

(G) Shaping one or more of the filament tape cleaning elements into one or more of the following shapes: curve, circle, coil.

5. The method of claim 1, further comprising the following step:

(H) Positioning at least one of the filament tape cleaning elements on a brush head.

6. The method of claim 1, further comprising the following step:

(H) Positioning at least two of the filament tape cleaning elements on a brush head.

* * * * *